US011408100B2

(12) United States Patent
Vanunu et al.

(10) Patent No.: US 11,408,100 B2
(45) Date of Patent: Aug. 9, 2022

(54) TERRY FABRIC WITH FAUX DOBBY AND METHODS OF MAKING TERRY FABRIC WITH FAUX DOBBY

(71) Applicant: Standard Textile Co., Inc., Cincinnati, OH (US)

(72) Inventors: Pinhas Vanunu, Cincinnati, OH (US); Scott D. McCormick, Cincinnati, OH (US); Niv Doron, Cincinnati, OH (US)

(73) Assignee: Standard Textile Co., Inc., Cincinnati, OH (US)

( * ) Notice: Subject to any disclaimer, the term of this patent is extended or adjusted under 35 U.S.C. 154(b) by 0 days.

(21) Appl. No.: 17/050,555

(22) PCT Filed: May 2, 2019

(86) PCT No.: PCT/US2019/030380
§ 371 (c)(1),
(2) Date: Oct. 26, 2020

(87) PCT Pub. No.: WO2019/213382
PCT Pub. Date: Nov. 7, 2019

(65) Prior Publication Data

US 2021/0238779 A1 Aug. 5, 2021

Related U.S. Application Data

(60) Provisional application No. 62/666,148, filed on May 3, 2018.

(51) Int. Cl.
*D03D 27/08* (2006.01)
*D03D 39/22* (2006.01)

(52) U.S. Cl.
CPC ..... *D03D 27/08* (2013.01)

(58) Field of Classification Search
CPC .. D03D 27/08; D03D 1/0017; A47G 27/0225; A47K 10/02; D10B 2503/06
See application file for complete search history.

(56) References Cited

U.S. PATENT DOCUMENTS 1,766,805 A * 6/1930 Wakefield ..... D03D 27/08 139/396
1,930,769 A * 10/1933 Parker ..... D03D 27/08 139/396

(Continued)

OTHER PUBLICATIONS

PCT Office, Search Report and Written Opinion issued in corresponding PCT/US2019/030380 dated Jul. 15, 2019.

(Continued)

*Primary Examiner* — Robert H Muromoto, Jr.
(74) *Attorney, Agent, or Firm* — Wood Herron & Evans LLP

(57) ABSTRACT

Described is a woven terry fabric article that includes a body having a first end and a second end opposite one another, and a first side edge and a second side edge opposite one another and generally perpendicular to the first and second opposite ends. The article further includes a first terry zone having a pile with a first pile height, a second terry zone having a pile with a second pile height, and a first faux dobby zone intermediate to the first and second terry zones. The first faux dobby zone has a pile with one or more pile heights that are visibly distinct from the pile heights of the first and second terry zones. In embodiments, the one or more pile heights in the faux dobby zone are less than the pile height of the adjacent zones, such as 50% less, 40% less, or 35% less.

26 Claims, 9 Drawing Sheets

(56) References Cited

U.S. PATENT DOCUMENTS

| | | | | |
|---|---|---|---|---|
| 4,726,400 | A * | 2/1988 | Heiman | D03D 27/08 139/396 |
| 9,850,599 | B2 * | 12/2017 | Stewart | D03D 27/08 |
| 2017/0073858 | A1 * | 3/2017 | Goenka | D03D 27/08 |
| 2017/0088984 | A1 * | 3/2017 | Stewart | D03D 27/08 |

OTHER PUBLICATIONS

PCT Office, Second Written Opinion issued in corresponding PCT/US2019/030380 dated Apr. 3, 2020.

* cited by examiner

TERRY FABRIC WITH FAUX DOBBY AND METHODS OF MAKING TERRY FABRIC WITH FAUX DOBBY

FIELD

The present invention relates to woven terry fabrics and, more particularly, to woven terry fabrics having a faux dobby and articles made therefrom.

BACKGROUND

Woven terry towels have long included dobby zones in one or more strips near the opposite ends of the towel. Dobby zones are primarily decorative elements that are associated with more luxurious and higher quality towels. As such, towels with dobby zones are sought after in the marketplace.

Warp terry pile fabric constitutes the main body and end zones of towels having dobby zones. The primary yarns visible across the body and end zones of these towels are the pile warp yarns. In contrast, standard dobby zones lack pile and the primary visible yarns are fill yarns.

Standard dobby zones have a higher weave density such as 33 picks/cm to 60 picks/cm in the fill when compared to the pile portion of the towel, which have a much lower weave density, such as between 10 picks/cm and 20 picks/cm in the fill. The higher density dobby zone may shrink differentially after bleaching and washing than the terry pile zones, which can result in puckering.

Further, the dobby zones require a significantly greater amount of time to weave when compared to the amount of time required to weave a similar length of terry fabric. As such, including dobby zones in towels increases the amount of time required to weave the fabric when compared with towels woven with pile from end to end and that exclude a traditional dobby section.

Towels having the aesthetic of a dobby section, but not the drawbacks, are desired.

SUMMARY

Aspects of the present invention provide an improved terry fabric having a faux dobby zone. Further aspects of the invention provide improved terry fabric articles, such as towels, having desirable drying characteristics and aesthetics while also having faux dobby zones that improve the efficiency with which the articles are made and reduce puckering. One way to accomplish this is to weave the fabric with a faux dobby zone created by weaving a pile in that zone to have a height that is visually distinct from the pile in immediately adjacent terry zones. In embodiments, the pile in the faux dobby zone is visibly lower than the pile in the adjacent zones so as to create a fabric having a faux dobby that is woven at the same or similar rates and density as the remainder of the fabric and gives the dobby appearance. The resulting terry fabric may be utilized to make a terry fabric article, such as a towel, having a faux dobby zone that is more or less imperceptible from conventionally woven terry fabric articles woven with standard dobby zones.

In particular, an aspect of the invention is directed to a terry fabric article that includes a body having a first end and a second end that are opposite one another and a first side edge and a second side edge that are also opposite another and generally perpendicular to the first and second opposite ends. The body also includes a plurality of zones extending across the fabric between the first and second opposite ends or the first and second opposite edges. The body also includes a first terry zone with a pile having a first pile height, a second terry zone with a pile having a second pile height, and a first faux dobby zone intermediate to the first and second terry zones. The first faux dobby zone has a pile with one or more heights that are visibly distinct from the pile heights of the adjacent first and second terry zones. In embodiments, the one or more heights of the pile in the first faux dobby zone is visibly less than the height of the pile in each of the first and second terry zones. In embodiments, the one or more heights of the pile in the first faux dobby zone is less than 50%, less than 40%, or less than 35% of the height of the pile in each of the first and second terry zones. In embodiments, the first faux dobby zone, first terry zone, and the second terry zone each have the same number of picks per centimeter in the fill. Embodiments of the invention may include one or more additional faux dobby zones and additional terry zones. The fabric may be utilized to produce a terry fabric article, such as a bath mat, a wash cloth, or a towel.

By virtue of the foregoing, there is thus provided a terry fabric, and terry fabric articles made therefrom, having a faux dobby that is as attractive as articles with regular dobby, but that is more efficiently produced and lacks the puckering that can occur after laundering prior art dobby towels. These and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate an embodiment of the invention and, together with the general description of the invention given above and the detailed description of the embodiments given below, serve to explain the principles of the present invention.

DETAILED DESCRIPTION OF THE DRAWINGS

Figure 1:
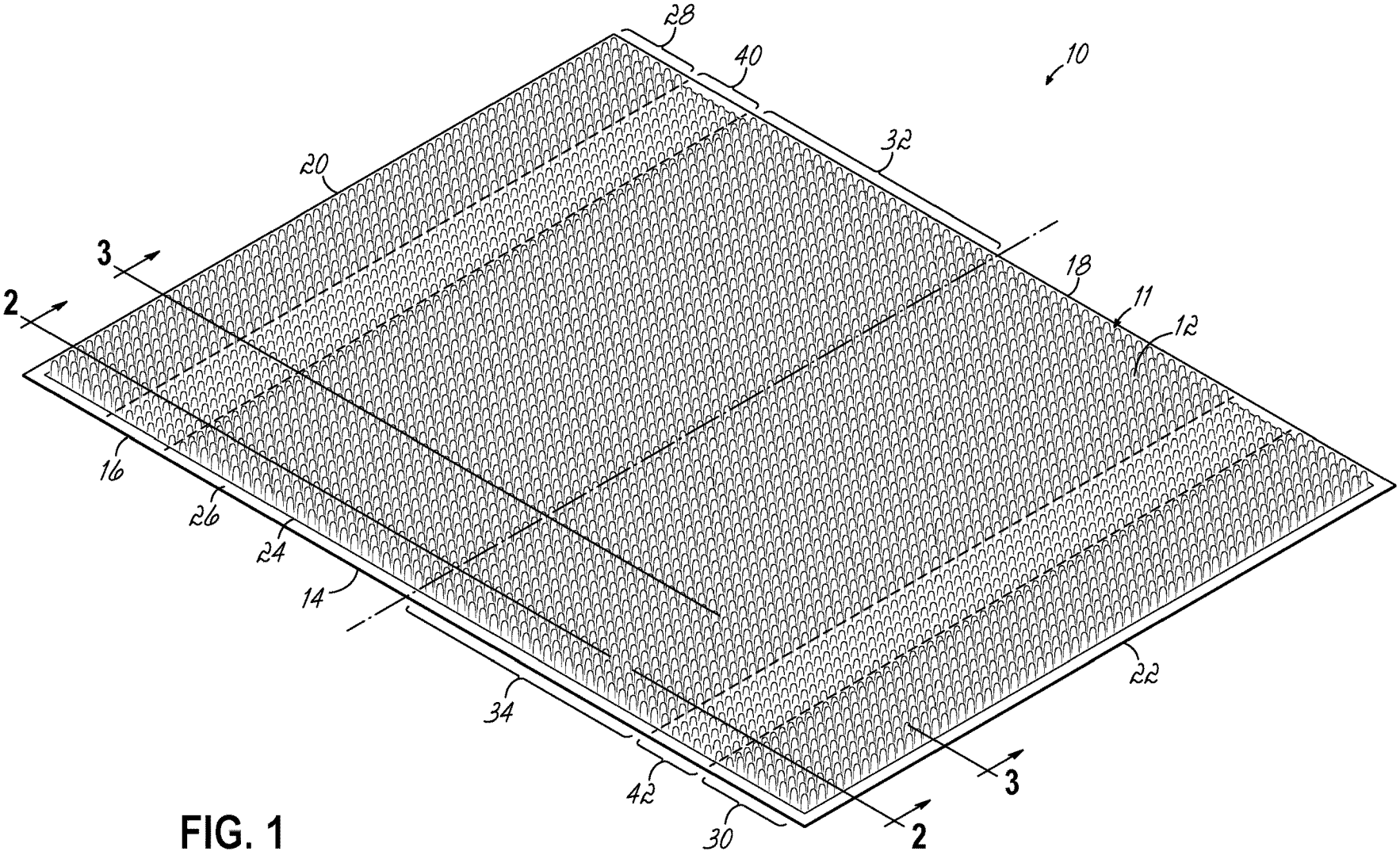
FIG. 1 is a perspective view of a woven terry fabric towel having faux dobby zones in accordance with the principles of the invention.
Figure 2:
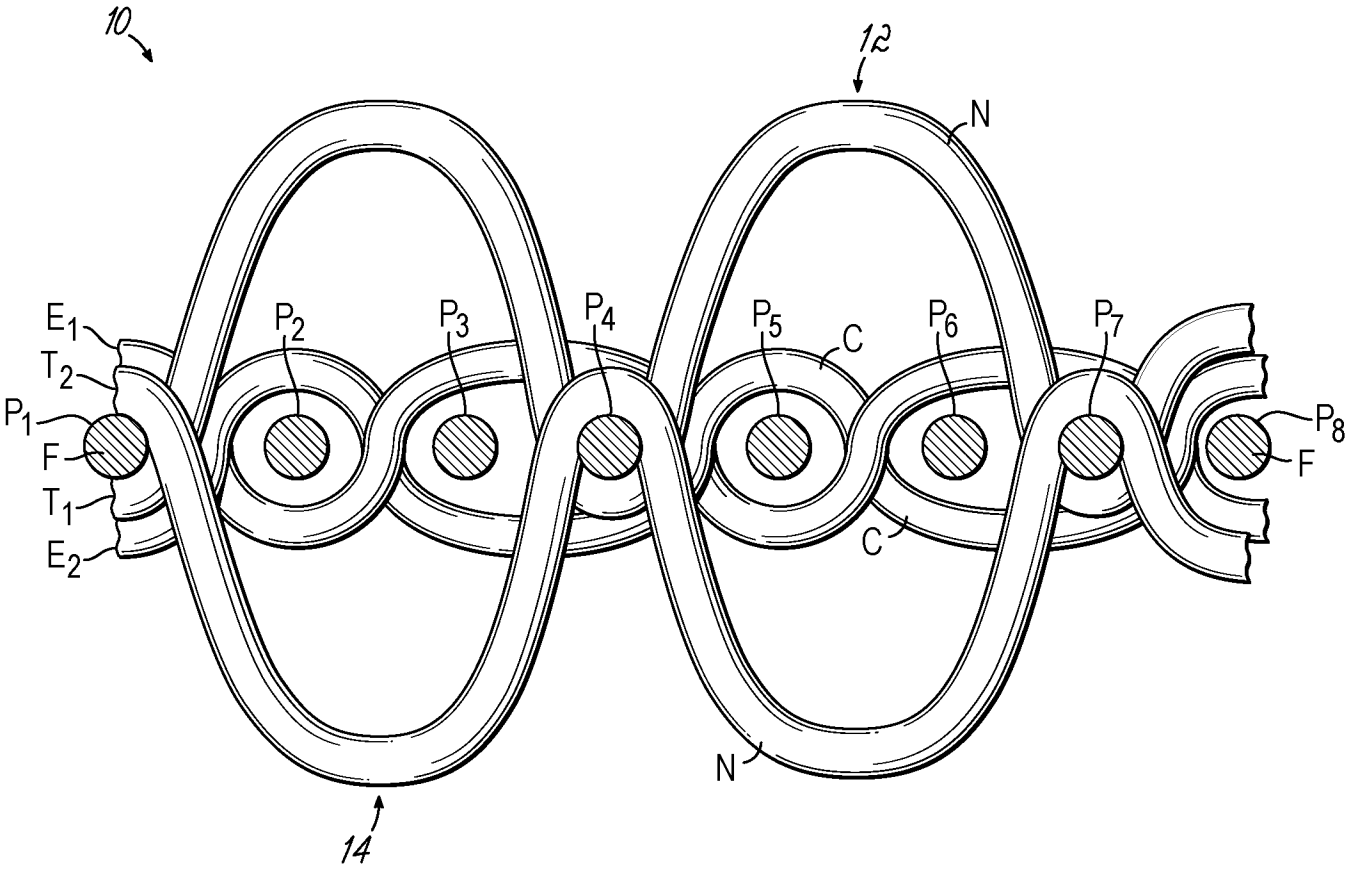
FIG. 2 is a partial, cross-sectional view, not to scale, taken along line 2-2 of FIG. 1.

With reference to FIGS. 1 and 2, an exemplary terry fabric article 10, a towel, has a body 11 and is woven in a three-pick terry weave and includes a top surface 12 and a bottom surface 14, with the surfaces 12, 14 extending between a left edge 16 and a right edge 18, as well as a top or trailing end 20 and a bottom or leading end 22. The exemplary article 10 also includes a hem 24 along the side edges 16, 18 and along opposite ends 20, 22, although it will be understood that a selvage (not shown) may be provided along opposite side edges 16, 18 in place of the hem, and that references herein to extending to the ends 20, 22 and/or edges 16, 18 of the article 10 contemplates extending to the beginning of the hems 24.

As shown in FIG. 2, the ground warp ends $E_1$, $E_2$ are formed of yarn C, the terry pile loops N are formed of yarns $T_1$, $T_2$, and the ground fill picks $P_1$, $P_2$, $P_3$, $P_4$, $P_5$, $P_6$, $P_7$, $P_8$ are formed of yarn F. The ground warp ends $E_1$, $E_2$ and the ground fill picks $P_1$, $P_2$, $P_3$, $P_4$, $P_5$, $P_6$, $P_7$, $P_5$ form the ground fabric. The terry pile loops N form the pile that projects from the surface of the ground fabric. In the exemplary embodiment illustrated in FIG. 2, the ground warp yarn C, terry pile loop yarn $T_1$, $T_2$, and ground fill yarn F are woven together in a three-pick terry weave. However, embodiments of the invention may utilize terry weaves having more than three picks, such as four-, five-, six-, or seven-pick terry weave. Although FIG. 2 illustrates part of a single warpwise row, the ground warp ends and terry pile loops of the other rows of the terry fabric 10 may be constructed and arranged as shown in FIG. 2.

Figure 3:
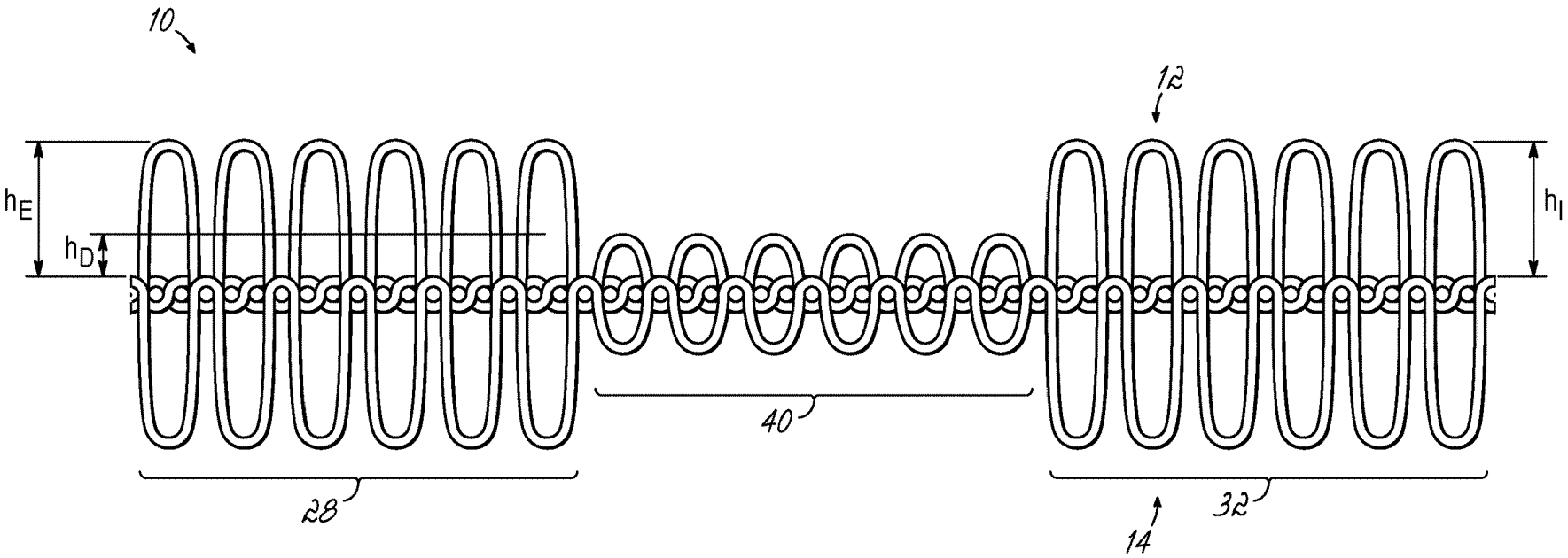
FIG. 3 is a partial, cross-sectional view, not to scale, of a portion of the terry fabric towel of FIG. 1 taken along line 3-3, in accordance with embodiments of the invention.
Figure 4:
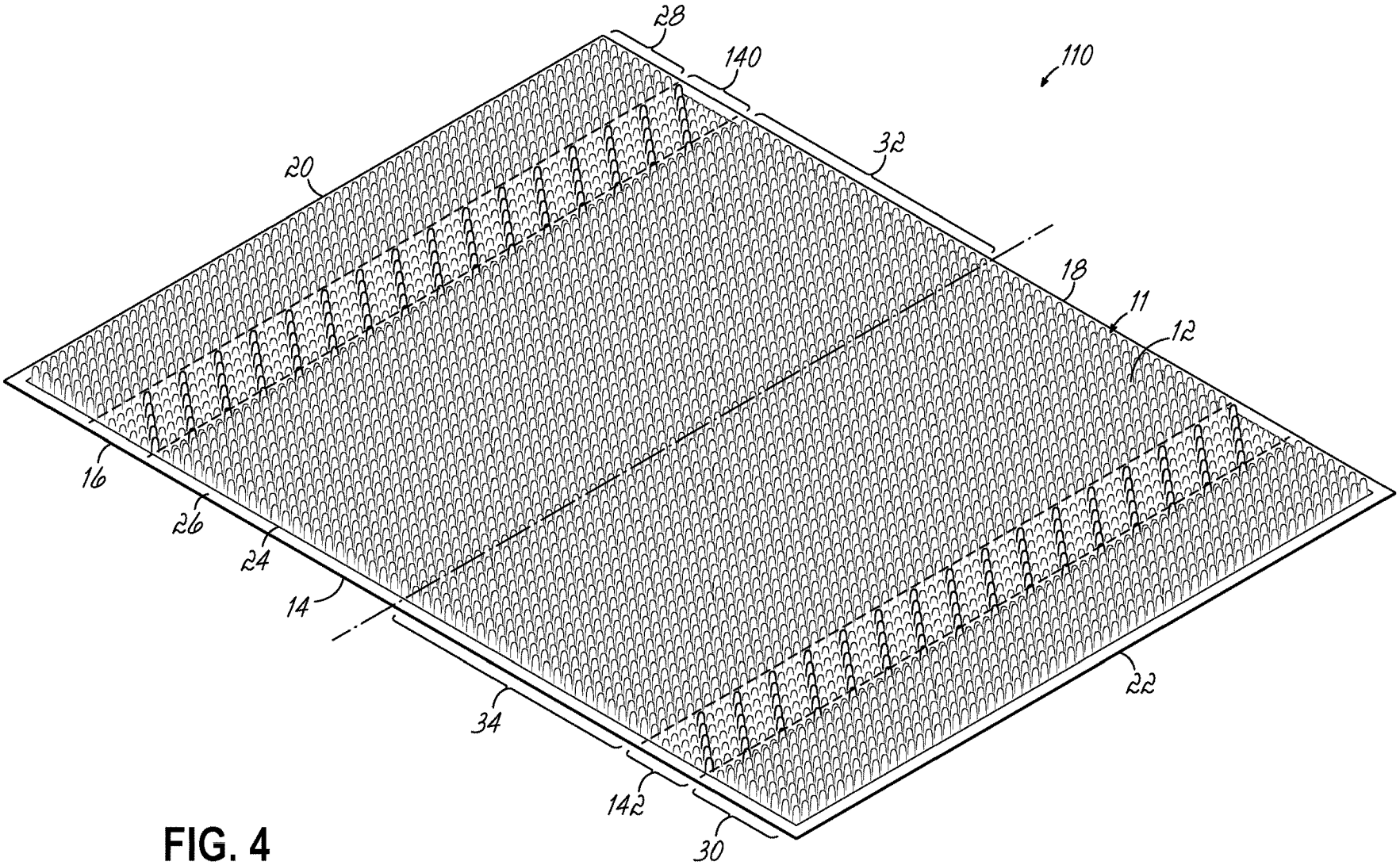
FIG. 4 is a perspective view of a woven terry fabric towel having patterned faux dobby zones in accordance with the principle of the invention.

The exemplary terry fabric articled 10 illustrated in FIGS. 1 and 4 are woven with a plurality of zones extending across the fabric, illustrated with broken lines. Each of the zones extends across the width of the article between the article's opposite edges 16, 18. The terry fabric articles 10, 110 each include a top end zone 28 adjacent the top end 20 of the article 10, 110 and a bottom end zone 30 adjacent the opposite bottom end 22 of the article 10, 110. With reference to FIG. 3, the pile in each of the top end zone 28 and the bottom end zone 30 has a pile height $h_E$. In embodiments of the invention, the pile height $h_E$ in the top end zone 28 is equal to the pile height $h_E$ in the bottom end zone 30. In other embodiments, pile height $h_E$ in the top end zone 28 is within 10% of the pile height $h_E$ in the bottom end zone 30.

The terry fabric articles 10, 110 also each include at least one intermediate terry zone 32, and in an embodiment, the article includes at least a second intermediate terry zone 34. The pile in each of the intermediate zone 32 and the second intermediate zone 34 has a pile height $h_I$. In an embodiment, the pile height $h_I$ in the intermediate zone 32 is equal to the pile height $h_I$ in the second intermediate zone 34. In other embodiments, the pile height $h_I$ in the intermediate zone 32 is within 10% of the pile height $h_I$ in the second intermediate zone 34. In embodiments of the invention, the pile height in one or both of the top and bottom end zones 28, 30 is equal to or within 10% of the pile height in one or both of the intermediate zone 32 and the second intermediate zone 34.

Figure 3A:
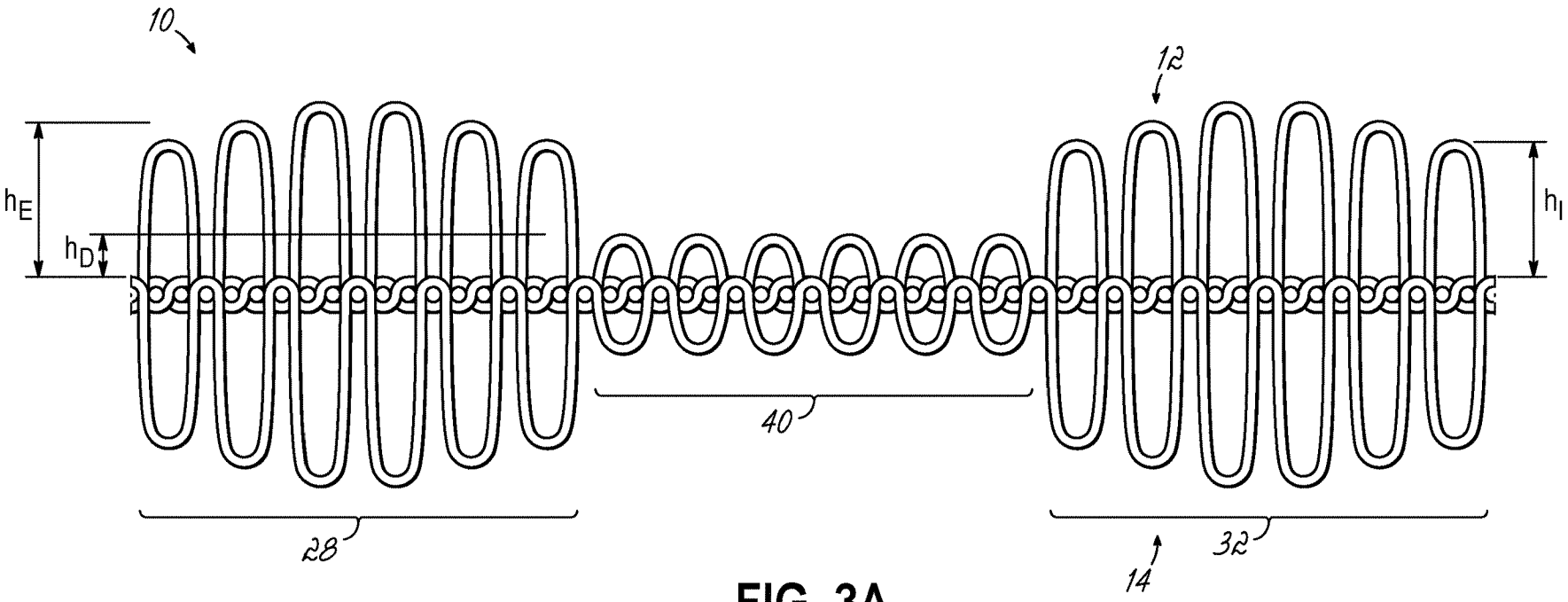
FIG. 3A is a partial, cross-sectional view, not to scale, of a portion of the terry fabric towel of FIG. 1 taken along line 3-3, illustrating an alternate embodiment of the invention.

It should be understood that the individual heights of pile loops N in one or more of the end zones 28, 30 and/or intermediate zones 32, 34 can vary from pile loop to pile loop within one or more zones 28, 30, 32, 34, such as to provide decorative patterns, for example. In one embodiment, as shown in FIG. 3A, the height of the pile loops N in the middle of each zone 28, 32 is greater than the height of the pile loops N at the edge of each zone 28, 32. Here, the increase or transition in height from pile loop N to pile loop N is gradual from opposite edges towards a center of the zone 28, 32, such as to define a parabolic type transition, for example. Other variations are contemplated and would be understood by those skilled in the art. Where variation is desired, for example, the difference in individual pile heights between the shortest and tallest pile loops N in the zones 28, 30, 32, 34 can be at least 5%, at least 10%, at least 20%, at least 30%, at least 40%, at least 50%, or at least 100%. In other embodiments, little to no height variation in the zones 28, 30, 32, 34 is desired, as depicted in FIG. 3, for example.

Figure 1A:
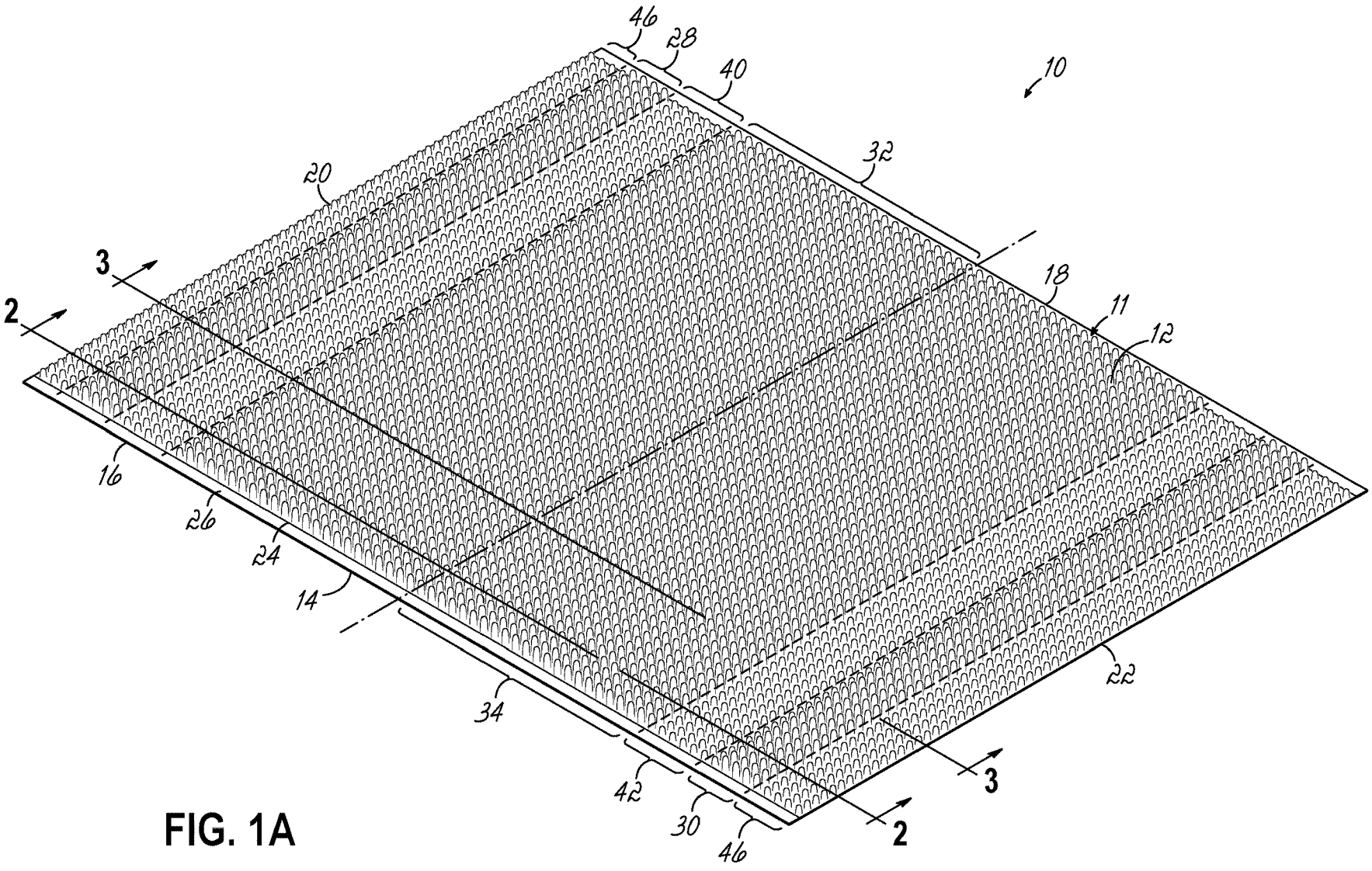
FIG. 1A is a perspective view of the woven terry fabric towel of FIG. 1 having faux dobby zones in accordance with an additional embodiment of the invention.
Figure 4A:
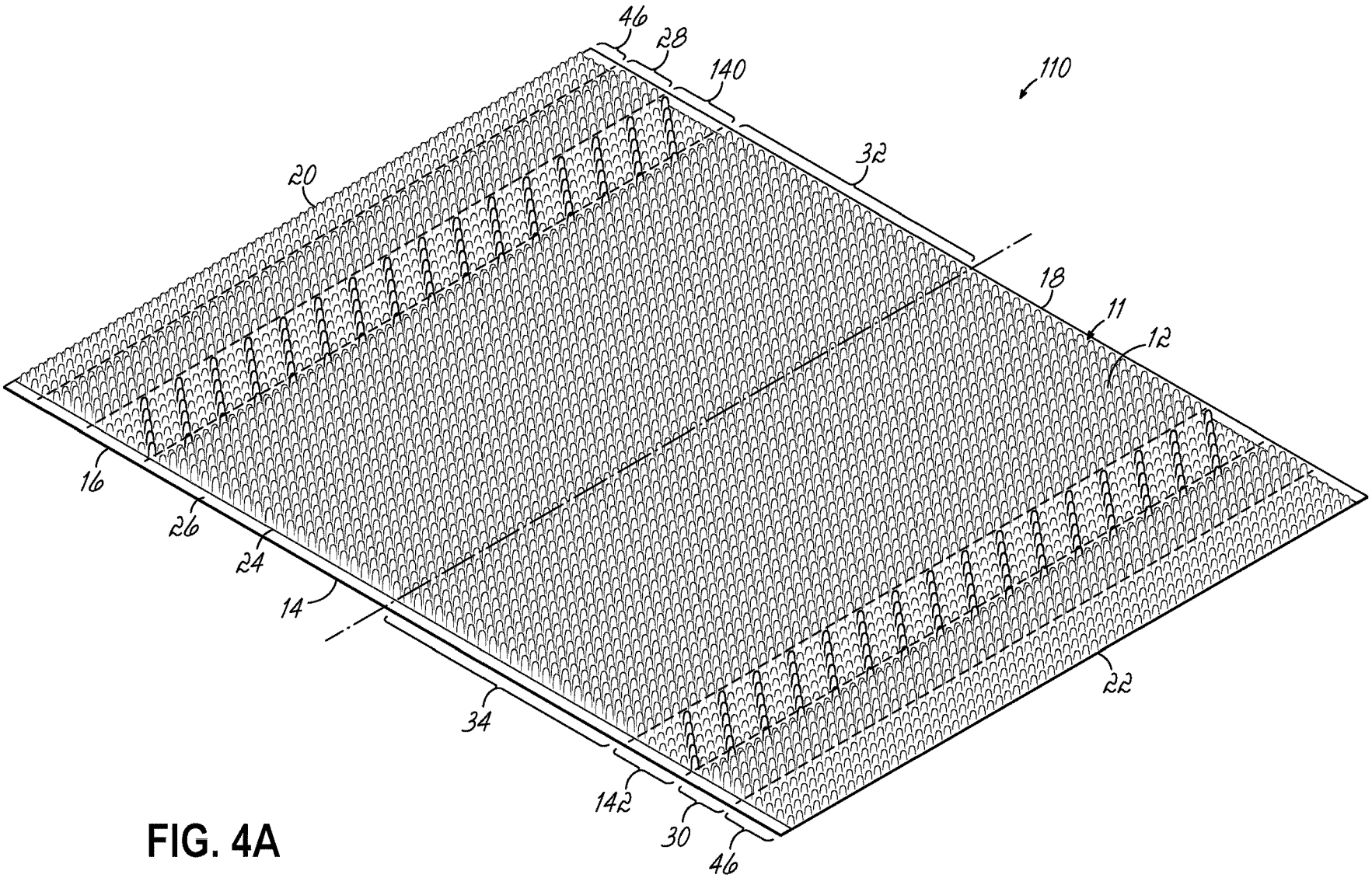
FIG. 4A is a perspective view of the woven terry fabric towel of FIG. 4 having patterned faux dobby zones in accordance with an additional embodiment of the invention.

With reference to FIGS. 1, 3, and 4, the exemplary terry fabric articles 10, 110 also include a decorative top faux dobby zone 40, 140 between the top end zone 28 and the intermediate zone 32 and a decorative bottom faux dobby zone 42, 142 between the bottom end zone 30 and the second intermediate zone 34. The top and bottom faux dobby zones 40, 42, 140, 142 each include a warp pile having a pile height $h_D$. While the embodiments illustrated in FIGS. 1 and 4 each includes two faux dobby zones 40, 42, 140, 142, one near each end of the terry fabric articles, embodiments of the invention may include multiple faux dobby zones near each end of the article, such as two or three faux dobby zones near each of the top and bottom end zones 28, 30 and that each faux dobby zone would be separated from the nearest faux dobby zone by an intermediate zone. Such an embodiment is illustrated in FIGS. 1A and 4A and further discussed below.

In embodiments of the invention, the height $h_D$ of the pile in the top and bottom faux dobby zones 40, 42, 140, 142 is visibly distinct from the heights $h_E$, $h_I$ of the pile in the adjacent top and bottom end zones 28, 30 (collectively referred to as "end zones") and the adjacent intermediate and second intermediate zones 32, 34 (collectively referred to as "intermediate zones"). Visibly distinct differences in pile height are differences in pile height that appear as a distinct edge between the pile of adjacent zones when viewed straight on by the casual observer with 20/20 vision under regular ambient indoor lighting conditions and without aid of magnification.

In embodiments of the invention, visibly distinct differences in pile height include a pile height $h_D$ in the faux dobby zones 40, 42, 140, 142 that is at least 35% different from the pile height in the immediately adjacent end zones 28, 30 and the immediately adjacent intermediate zones 32, 34. In embodiments of the invention, visibly distinct differences in pile height include a pile height $h_D$ in the faux dobby zones 40, 42, 140, 142 that is at least 40% different from the pile height in the immediately adjacent end zones 28, 30 and the immediately adjacent intermediate zones 32, 34. In embodiments of the invention, visibly distinct differences in pile height include a pile height $h_D$ in the faux dobby zones 40, 42, 140, 142 that is at least 50% different from the pile height in the immediately adjacent end zones 28, 30 and the immediately adjacent intermediate zones 32, 34. In preferred embodiments, the pile height in the faux dobby zones is less than the pile height in the immediately adjacent end zones 28, 30 and in immediately adjacent intermediate zones 32, 34. For example, the difference in pile height $h_D$ in the faux dobby zones 40, 42, 140, 142 could be at least 35%, at least 40%, or at least 50% less than the height of the immediately adjacent end zone and immediately adjacent intermediate zone. The pile height $h_D$ in the faux dobby zone is the average pile height in the faux dobby zone 40, 42, 140, 142 relative to the average pile height in the immediately adjacent zones, e.g., end zones 28, 30 or intermediate zones 32, 34.

Figure 3B:
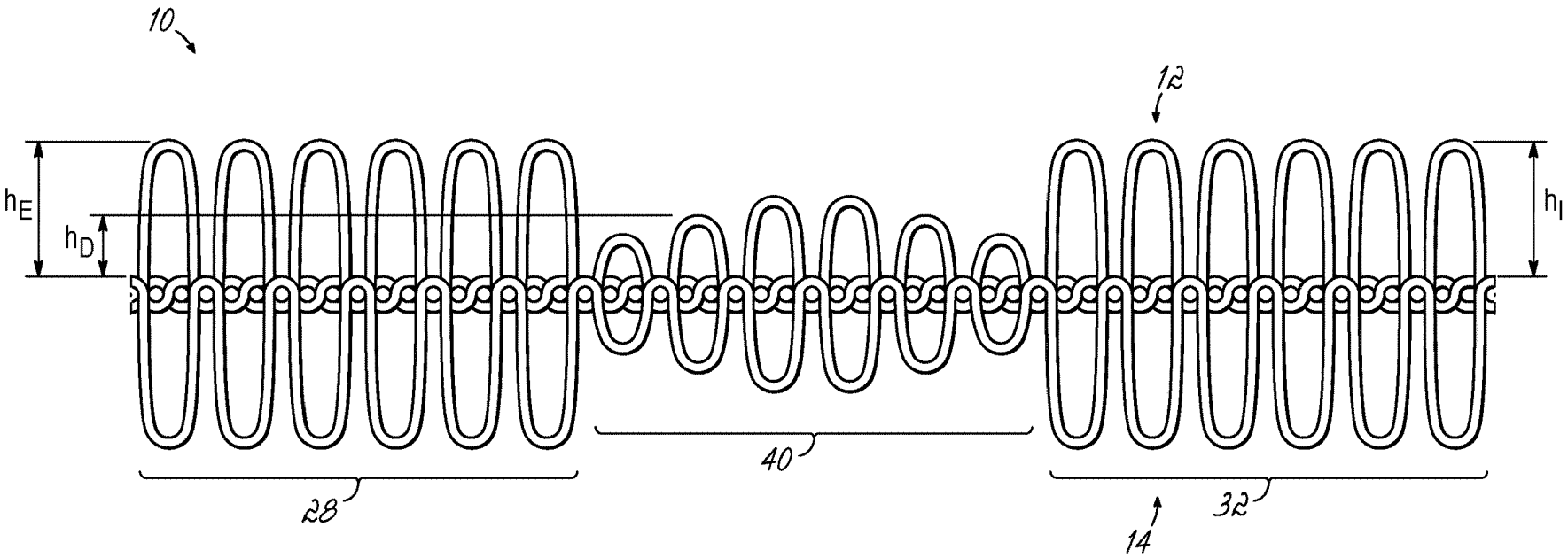
FIG. 3B is a partial, cross-sectional view, not to scale, of a portion of the terry fabric towel of FIG. 1 taken along line 3-3, illustrating an alternate embodiment of the invention.

It should be understood that the individual heights of pile loops N in a faux dobby zone 40, 42, 140, 142 can vary from pile loop to pile loop within that zone, such as to provide decorative patterns, for example. In one embodiment, as shown in FIG. 3B, the height of the pile loops N in the middle of the faux dobby zone 40 is greater than the height of the pile loops N at the edge of the faux dobby zone 40. Here, the increase or transition in height from pile loop N to pile loop N is gradual from opposite edges towards a center of the faux dobby zone 40, such as to define a parabolic type transition, for example. Other variations are contemplated and would be understood by those skilled in the art. Where variation is desired, for example, the difference in individual pile heights between the shortest and tallest pile loops N in the faux dobby zones 40, 42, 140, 142 can be at least 5%, at least 10%, at least 20%, at least 30%, at least 40%, at least 50%, or at least 100%. In other embodiments, little to no height variation in the faux dobby zone 40, 42 is desired, as depicted in FIG. 3, for example. In addition, the pile height in the top faux dobby zone 40, 140 may be equal to or within 10% of the pile height in the bottom faux dobby zone 42, 142. Further yet, while the height of the pile loops N in the faux dobby zones 40, 42, 140, 142 is shown as being less than those in adjacent zones, e.g., end zones 28, 30 or intermediate zones 32, 34, it should be understood that the pile loops N in the faux dobby zones 40, 42, 140, 142 can be greater than those in those adjacent zones. For example, the difference in pile height $h_D$ in the faux dobby zones 40, 42, 140, 142 could be at least 35%, at least 40%, or at least 50% greater than the height of the immediately adjacent end zone and immediately adjacent intermediate zone so as to provide visibly distinct differences in pile.

With reference again to the exemplary embodiment illustrated in FIG. 1, the pile in the faux dobby zones 40, 42 may be woven with a flat plain weave. FIG. 4 illustrates an additional exemplary embodiment of a terry fabric article 110 in which, the pile in the faux dobby zones 140, 142 is woven to form decorative patterns by selectively varying the pile height in the zones 140, 142, as discussed above.

Traditional towels are often woven with cam borders having a flat pile yarn (i.e., the pile is not raised like normal terry pile) that is not used to create an aesthetic embellishment. In contrast and as illustrated in FIGS. 1A and 4A, embodiments of the invention also may include decorative border faux dobby zones 46 along the edges 16, 18 and ends 20, 22 of the terry fabric articles 10, 110 thereby adding a decorative element to the border of the articles 10, 110. The border faux dobby zones 46 may extend from the edge of the towel like the pile in the faux dobby zones 40, 42, 140, and 142, the pile in the border faux dobby zones 46 is visibly distinct from the heights of the pile in the adjacent end zones 28, 30. In embodiments of the invention, visibly distinct differences in pile height include a pile height in the border faux dobby zones 46 that can be at least 35% different from the pile height in the immediately adjacent end zones 28, 30. In embodiments of the invention, visibly distinct differences in pile height include a pile height in the border faux dobby zones 46 that can be at least 40% different from the pile height in the immediately adjacent end zones 28, 30. In embodiments of the invention, visibly distinct differences in pile height include a pile height in the border faux dobby zones 46 that is at least 50% different from the pile height in the immediately adjacent end zones 28, 30. In preferred embodiments, the pile height in the border faux dobby zones 46 is less than the pile height in the immediately adjacent end zones 28, 30. For example, the difference in pile height in the border faux dobby zones 46 could be at least 35%, at least 40%, or at least 50% less than the height of the immediately adjacent end zone. As discussed above, the pile height in the border faux dobby zone 46 is the average pile height in the border faux dobby zone 46 relative to the average pile height in the immediately adjacent zones, e.g., end zones 28, 30. Also, like in FIG. 3B, the height of the pile loops N in the middle of the faux dobby zones 46 can greater than the height of the pile loops N at the edge of the faux dobby zone 46. As shown in FIG. 4A, the pile in the border faux dobby zones 46 may be woven to form decorative patterns by selectively varying the pile height in the faux dobby borders 46, like as shown in FIG. 4.

Figure 3C:
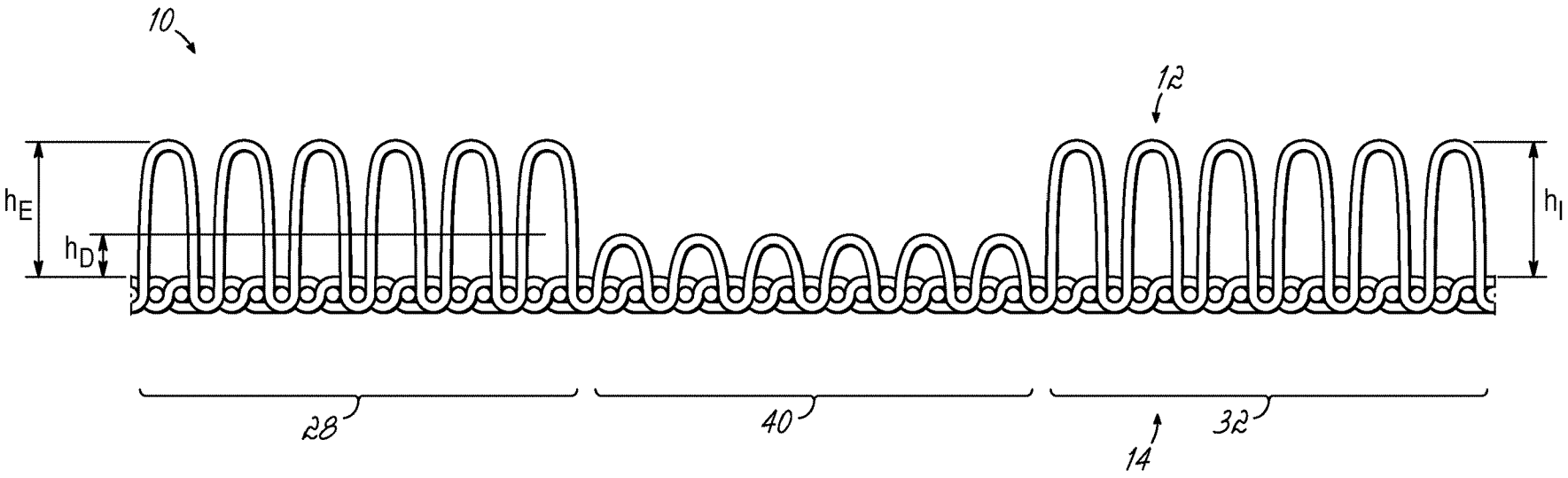
FIG. 3C is a partial, cross-sectional view, not to scale, of a portion of the terry fabric towel of FIG. 1 taken along line 3-3, illustrating an alternate embodiment of the invention.

The heights of the pile may be measured as the distance that the pile projects from the ground fabric. In embodiments of the invention, the pile height in the intermediate and end zones may range from between about 5 mm and about 10 mm. In embodiments of the invention having terry fabric with a double-sided pile, the total thickness of the pile from both sides of the fabric in the intermediate and end zones may range between about 10 mm and about 20 mm. As described above, the one or more pile heights in the faux dobby zones will be visibly distinct from the pile heights in the adjacent intermediate and end zones. In another embodiment, as shown in FIG. 3C, the terry fabric article 10 has only a single-sided pile formed by yarns $T_1$ and $T_2$ where yarn $T_2$, like yarn $T_1$, can be woven so that it is provided on the top surface 12 of the terry fabric article 10, according to methods as would be understood by those skilled in the art. Alternatively, it should be understood that a single-sided pile could be formed by yarns $T_1$ and $T_2$ where yarn $T_1$, like yarn $T_2$, can be woven so that it is provided on the bottom surface 14 of the terry fabric article 10.

The pile height may also be considered as a function of the terry ratio, which is an expression of the length of yarn consumed for the pile as compared to the ground warp. In an embodiment of the invention, the fabric in the intermediate and end zones may have a terry ratio which ranges between about 1:1 and about 12:1. In another embodiment, the fabric in the intermediate and end zones may have a terry ratio which ranges between about 3:1 and 12:1 or about 5:1 and 11:1.

The yarns defining the ground fill, ground warp, and pile warp of embodiments of the terry fabric articles 10, 110 may be made of any suitable material including yarns made of natural material, synthetic material, and combinations thereof. In an embodiment, at least a portion of the yarns include hydrophilic fibers, such as cotton or other cellulosic fibers that may optionally be blended with synthetic yarns such as polyester in spun or filament yarn form. Such yarns are known in the art. Further, depending upon the desired characteristic of the fabric, the ground fill and ground warp may be selected of appropriate materials and the pile warp may be selected of the same or different materials, likewise any combination of yarns may be utilized to define the ground fill, ground warp, and pile warp as desired.

The terry fabrics described herein may be used to manufacture any sort of terry fabric article, such as bath mats, wash cloths, and towels including bath sheets, bath towels, hand towels, and dish towels.

As the fabric is woven for articles 10, 110, the pile height for each zone 28, 30, 32, 34, 40, 42, 140, 142 of the body 31 of the article 10 is woven to have the desired height. In an embodiment, terry fabric is woven on a terry loom capable of weaving the terry fabric with the desired pile height in each zone. Notably, when weaving the fabric to result in the present invention, the height of the pile may be adjusted without significant additional adjustments to the weaving process or the density of the fabric in the faux dobby zone. For example, prior art standard dobby zones have between 33 and 60 picks/cm and the visible yarns forming the pattern of the dobby are in the fill. The number of picks per centimeter in prior art standard dobby zones are more than 200% the number of picks per centimeter fill found in the terry fabric outside of the dobby zones. In contrast, in embodiments of the present invention, the visible yarns are in the warp and the number of picks per centimeter fill in the faux dobby zones 40, 42, 140, 142 is no more than 200% of the number of picks per centimeter fill in the end zones 28, 30 and the intermediate zones 32, 34. In embodiments, the number of picks per centimeter fill in the faux dobby zones 40, 42, 140, 142 is up 150% of the number of picks per centimeter fill in the end zones 28, 30 and the intermediate zones 32, 34. In embodiments, the number of picks per centimeter fill in the faux dobby zones 40, 42, 140, 142 is up 125% of the number of picks per centimeter fill in the end zones 28, 30 and the intermediate zones 32, 34. In embodiments, the number of picks per centimeter fill in the faux dobby zones 40, 42, 140, 142 is within 10% of the number of picks per centimeter fill in the end zones 28, 30 and the intermediate zones 32, 34. In embodiments, the number of picks per centimeter fill in the faux dobby zones 40, 42, 140, 142 is the same as the number of picks per centimeter fill in the end zones 28, 30 and the intermediate zones 32, 34. In an exemplary embodiment, the faux dobby zones 40, 42, 140, 142 as well as the end zones 28, 30 and the intermediate zones 32, 34 may include from 10 picks per centimeter fill to 18 picks per centimeter fill. The higher density weave in prior art dobby zones results in thick tucked hems or selvages as well as puckering caused by differential shrinking in the dobby zones as compared to the remainder of the towel. The lower density of embodiments of the inventions described herein allows for thinner tucked hems or selvages in the faux dobby zone, which are aesthetically pleasing, and shrinkage that matches the remainder of the towel.

The presently described faux dobby fabrics can be used to produce articles, such as towels, that have the look and feel of more expensive and luxurious towels in less time when compared to weaving fabrics having standard dobby zones. In embodiments of the invention, the faux dobby fabric may be woven, on average, at least 100% more quickly than similar fabric having a standard dobby.

By virtue of the foregoing, there is thus provided a woven terry fabric towel 10 with faux dobby zones having the advantages described herein.

While the present invention has been illustrated by the description of embodiments thereof and specific examples, and while the embodiments have been described in considerable detail, it is not intended to restrict or in any way limit the scope of the appended claims to such detail. Additional advantages and modifications will readily appear to those skilled in the art. For example, although the drawings illustrate a three-pick terry-weave pattern, any suitable pattern may be used to form the woven terry fabric. It is further contemplated that the article could include one or more terry zones between the faux dobby zones and that more than one faux dobby zone may be associated with each end of the towel. Further, patterns can be formed in the faux dobby by varying the height of the pile to result in the desired pattern. Additionally, if more than one yarn type is used in the warp, any desired sequence or pattern of spun yarn and/or synthetic filament yarn may be used. Also, the woven terry fabric may include synthetic fibers, filaments, and/or yarns in the pile loops, with the synthetic material being polyester and/or other suitable synthetic material(s). Thus, the invention in its broader aspects is therefore not limited to the specific details, representative apparatus and methods and illustrative examples shown and described. Accordingly, departures may be made from such details without departing from the scope or spirit of applicant's general inventive concept.

What is claimed is:

1. A woven terry fabric article comprising:

a body including a first end and a second end, wherein the first and second ends are opposite one another, a first side edge and a second side edge, wherein the first and second side edges are opposite one another and generally perpendicular to the first and second opposite ends, and a first terry zone having a pile with a first pile height;

a second terry zone having a pile with a second pile height, which may be the same as or different from the first pile height, and wherein the first and/or second terry zone extends between the first edge and the second edge of the body;

a first faux dobby zone intermediate to and immediately adjacent the first and second terry zones, the first faux dobby zone having a pile with one or more heights that is at least 35% less than the height of the pile in each of the first and second terry zones to provide a distinct edge between the pile of the first and second terry zones, wherein the first faux dobby zone extends between the first edge and the second edge of the body, and wherein the pile of the first terry zone, second terry zone, and first faux dobby zone is formed by a singular yarn type that is the same and continuous throughout the length of the body of the woven terry fabric article and wherein the number of picks per centimeter in the fill of the first faux dobby zone is no more than 200% the number of picks per centimeter in the fill of the first terry zone and the second terry zone.

2. The woven terry fabric article of claim 1, wherein the one or more pile heights of the first faux dobby zone is less than 50% of the height of the pile in each of the first and second terry zones.

3. The woven terry fabric article of claim 1, wherein the first faux dobby zone, first terry zone, and the second terry zone each have the same number of picks per centimeter in the fill.

4. The woven terry fabric article of claim 1, wherein the first terry zone is adjacent the first end of the body.

5. The woven terry fabric article of claim 1, wherein the height of the pile in the first terry zone is equal to the height of the pile in the second terry zone.

6. The woven terry fabric article of claim 1, wherein the height of the pile in the first terry zone is within 10% of the height of the pile in the second terry zone.

7. The woven terry fabric article of claim 1, further comprising:

a third terry zone having a pile with a third pile height;

a fourth terry zone having a pile with a fourth pile height;

a second faux dobby zone intermediate and immediately adjacent to the third and fourth terry zones, the second faux dobby zone having a pile with one or more heights that are less than the pile heights of the third and fourth terry zones to provide a distinct edge between the pile of the first and second terry zones.

8. The woven terry fabric article of claim 7, wherein the pile of the second faux dobby zone has one or more heights that is at least 35% less than the height of the pile in each of the third and fourth terry zones.

9. The woven terry fabric article of claim 7, wherein the one or more pile heights of the second faux dobby zone is less than 50% of the height of the pile in each of the third and fourth terry zones.

10. The woven terry fabric article of claim 7 wherein the second faux dobby zone, third terry zone, and the fourth terry zone each have the same number of picks per centimeter in the fill.

11. The woven terry fabric article of claim 7, wherein the third terry zone is adjacent the second end of the body.

12. The woven terry fabric article of claim 7, wherein the third and/or fourth terry zone extends between the first edge and the second edge of the body.

13. The woven terry fabric article of claim 7, wherein the second faux dobby zone extends between the first edge and the second edge of the body.

14. The woven terry fabric article of claim 7, wherein the height of the pile in the third terry zone is equal to the height of the pile in the fourth terry zone.

15. The woven terry fabric article of claim 7, wherein the height of the pile in the third terry zone is within 10% of the height of the pile in the fourth terry zone.

16. The woven terry fabric article of claim 7, wherein the fourth terry zone is continuous with the second terry zone and the height of the pile in the fourth terry zone is equal to the height of the pile in the second terry zone.

17. The woven terry fabric article of claim 1, wherein the first and/or second faux dobby zone has more than one pile height that forms a pattern.

18. The woven terry fabric article of claim 7 further comprising a third faux dobby zone adjacent at least one of the first edge or the second edge, the third faux dobby zone having a pile with one or more heights that are less than the pile heights of the first terry zone, which is adjacent the third dobby zone, to provide a distinct edge between the pile of the first terry zone.

19. The woven terry fabric article of claim 1 further comprising a third faux dobby zone adjacent each of the first edge and the second edge, the third faux dobby zone having a pile with one or more heights that are less than the pile heights of the first and third terry zones, which are adjacent to a respective third faux dobby zone, to provide a distinct edge between the pile of the first and third terry zones.

20. The woven terry fabric article of claim 1, wherein the terry fabric article is a bath mat.

21. The woven terry fabric article of claim 1, wherein the terry fabric article is a wash cloth.

22. The woven terry fabric article of claim 1, wherein the terry fabric article is a towel.

23. The woven terry fabric article of claim 22 wherein the towel is selected from the group consisting of a bath sheet, a bath towel, a hand towel, and a dish towel.

24. A method of weaving the terry fabric article of claim 1 comprising weaving a terry fabric having a first terry zone, a second terry zone, and a faux dobby zone intermediate and immediately adjacent the first and second terry zones, the faux dobby having a pile with one or more pile heights that is at least 35% less than the height of a pile in each of the first and second terry zones to provide a distinct edge between the pile of the first and second terry zones.

25. The woven terry fabric article of claim 1, wherein the first and second pile heights in the first and second terry zones are from about 5 mm to about 10 mm.

26. The woven terry fabric article of claim 1, wherein the first and second pile heights in the first and second terry zones are from about 5 mm to about 10 mm and the one or more pile heights of the first faux dobby zone is less than 50% of the height of the pile in each of the first and second terry zones to provide the distinct edge between the pile of the first and second terry zones.

* * * * *